United States Patent [19]

Kern

[11] Patent Number: 4,890,830

[45] Date of Patent: Jan. 2, 1990

[54] BODY FITNESS TRAINING APPARATUS TO EXERCISE MUSCLES

[76] Inventor: Bernhard Kern, Kropsburgstrasse 10, 6800 Mannheim 81, Fed. Rep. of Germany

[21] Appl. No.: 231,476

[22] Filed: Aug. 12, 1988

[30] Foreign Application Priority Data

Jun. 7, 1988 [DE] Fed. Rep. of Germany ..... 3819276

[51] Int. Cl.[4] ..... A63B 21/06

[52] U.S. Cl. ..... 272/117; 272/134; 272/144

[58] Field of Search ..... 272/117, 118, 123, 134, 272/DIG. 4, 144

[56] References Cited

U.S. PATENT DOCUMENTS

| | | | |
|---|---|---|---|
| 3,734,495 | 5/1973 | Nist et al. | 272/118 |
| 3,851,916 | 12/1974 | Quartollo | 272/144 X |
| 4,407,495 | 10/1983 | Wilson | 272/117 |
| 4,426,077 | 1/1984 | Belker | 272/118 |
| 4,609,189 | 9/1986 | Brasher | 272/118 |
| 4,621,807 | 11/1986 | Stramer | 272/118 X |
| 4,629,185 | 12/1986 | Amann | 272/134 X |
| 4,632,390 | 12/1986 | Richey | 272/134 X |
| 4,678,187 | 7/1987 | Prsala | 272/134 X |
| 4,705,271 | 11/1987 | Mondloch et al. | 272/134 X |
| 4,807,871 | 2/1989 | Bryson | 272/118 X |

*Primary Examiner*—Richard J. Apley
*Assistant Examiner*—Robert W. Bahr
*Attorney, Agent, or Firm*—Staas & Halsey

[57] ABSTRACT

A body fitness training apparatus to exercise the muscles is described including a lever arm positioned on a frame and seating equipment. A self-stabilizing frame with attached cable guide rolls, a weight plate held on shafts by sleeves, a telescope which adjusts the weight power and which is movably arranged in or at a vertical lever, and a seating wedge stop arranged on the frame.

8 Claims, 18 Drawing Sheets

FIG. 39
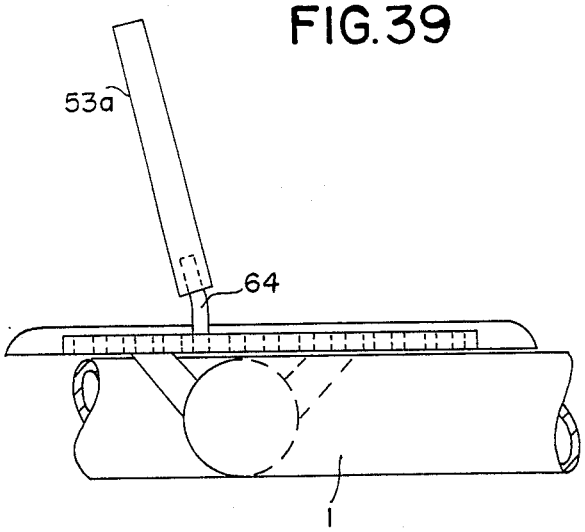
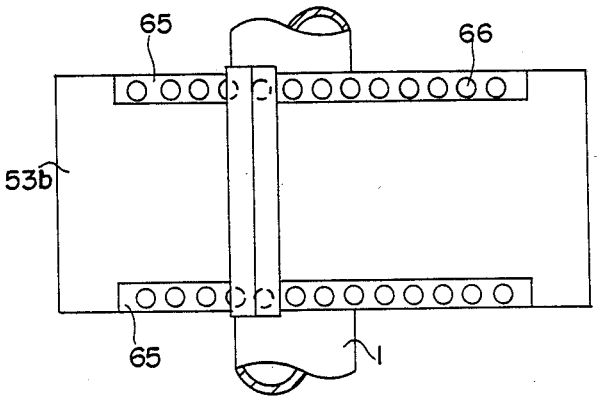
FIG. 40

BODY FITNESS TRAINING APPARATUS TO EXERCISE MUSCLES

BACKGROUND OF THE INVENTION

The invention concerns a body fitness training apparatus to exercise muscles.

There are numerous different training apparatuses known, which serve to exercise and to regenerate the muscles of the human body.

The training apparatuses according to prior art are designed in such a way, that a multiply divided weight block forms the weight power acting on a lever. Thereby, by the person carrying out exercises, the weight burdens have to be combined by elements of the weight block. That means, the weight block is mostly divided into single weight pieces. For example, with 5 kg weight pieces, ten unit weights of 5 kg each are combined to form a 50 kg weight block.

This is very time consuming for the person undergoing exercise.

Since the weight block and the unit weights have to be accessible permanently for the exercising persons, it is not possible to enclose those units into a protective casing.

According to the arrangement of the weights at the body fitness training apparatus, enclosing the weights, however, may be necessary to prevent accidents.

Known training apparatuses which enable varying weight power via a lever, show the disadvantage that the weight power acts directly upon the lever, which is moved by muscle power, and thus places extreme demands on the utilized connection elements, or the lever demonstrates in its maximum position that the most favorite lever for the utilizer with lowest necessary muscle power is an extremely long lever way, which again places an extreme effect on the training apparatus, which leads eventually to deformation of material or destruction.

A disadvantage of training apparatuses according to prior art consists in particular in the fact that during extreme exercises these apparatuses begin to vibrate. This results in uncontrolled influences of power on the muscles of the exercising persons and causes dangerous injuries.

Moreover, the seating equipment of the training apparatuses according to prior art are designed unsatisfactorily, since the muscle power brought upon by the exercising person often acts in full power on the seating equipment and the fixing elements.

Taking into consideration the accident prevention rules, the permitted training power is often limited by the so far unsatisfactory seating stops.

An additional disadvantage of training apparatuses according to the prior art is that the utilizer can vary weight power acting upon the apparatus only in a range below the weight block power present. With the apparatuses known it is not possible to change the lever arm in such a way as to increase the required muscle power above the weight power present. In this case, the exercise spectrum is also limited.

SUMMARY OF THE INVENTION

The invention therefore has the objective, to present a body fitness training apparatus which makes it possible to vary the exercising power which is to be adjusted, from a seating position, whereby the weight power and the training power act upon the training apparatus in such a way, as to avoid undesired vibrations and whereby the training apparatus is of such a stable version, that the lever arm can be changed in such a way, as to make it possible to increase the necessary training power beyond the weight power, if required, whereby the seat stop of the training apparatus is made in an appropriately stable way.

This objective is solved according to the invention in such a fashion, that the body fitness training apparatus consists of a self-stabilizing frame with attached cable-guide rollers, a weight plate guided along sleeve columns by means of sleeves, a telescope which is attached at or in a lever and is vertically movable and adjusts the weight power, and a seating wedge stop attached to the frame.

A particularly preferred example of the present invention is characterized in that the frame is preferably made of round, neatly fitting cornerless steel pipe material, which is formed into a rectangularly formed frame with rounded corners, consisting of vertical supports and cross pipes, as well as an angle frame connected to the frame by means of traverse trussings and consisting of vertical supports and angled traverse pipes.

Further characterizing items of the body fitness training apparatus according to the invention are characterized in the between cross pipes sleeve columns are arranged, which are surrounded by sleeves (one each) carrying the weight plate, and that at the frame there is arranged a telescope which adjusts the weight power and which is mobile in or at the lever and is in connection with a traction rope.

Furthermore, the invention is characterized in that at or in the lever a guide rail is arranged, that at the telescope a power transmission element is arranged which is equipped with a turnable roll, that the power transmission element is formed as a packing ring which covers the telescope and is connected with the traction rope and that the guide rail of lever is formed angularly.

A further characterizing feature of the invention consists in that an angular cross pipe is arranged as a seating wedge stop, consisting of a bung rail, a slide wedge and a screw handle with a stop plate and guide wedge, that the slide wedge features a slit which accepts the bung and is, at least on the lateral edge facing the screw handle, formed wedge-shaped and features at least one spring-stop, that the bung rail features a stop and a bung as well as at least one slot groove accepting a pressure spring and that the lever is formed in a "U"-shape with bent arms, the angle elbows of which are pivotably arranged in supports by means of axles.

An additional characterizing feature of the invention is that the telescope is pivotably arranged by means of a distance plate at axis, that the telescope is pivotably arranged at a cross pipe or angle pipe by means of an axle, that the telescope features pneumatic or hydraulic connections, that the lever is formed in an arched shape, and that the power transmission element features a swivel axis of rotation.

Finally, further characterizing features of the invention are that the telescope is arranged movably within a groove at the power transmission element, that the cable guide roller is pivotably arranged in a plate fixed to the frame, that the plate features a radial groove in which the cable guide roller is pivotably arranged by means of a shaft, that the lever features a setting mechanism in the form of a gear rack, slotted disk or perforated disk and that the back rest of the seat is formed so as to be reversibly fixed by means of connection devices.

BRIEF DESCRIPTION OF THE DRAWINGS

The invention is now further explained by means of the attached drawings, which show particular preferred embodiments of examples of the present invention.

Wherein show FIGS. 1–5:

The self stabilizing frame in perspective and from various directions, whereupon to clarify the frame structure not all additional parts are shown, FIGS. 39 and 40 are the back seat which can be reversibly fixed by means of connection devices.

DETAILED DESCRIPTION OF THE PREFERRED EMBODIMENTS

Figure 1:
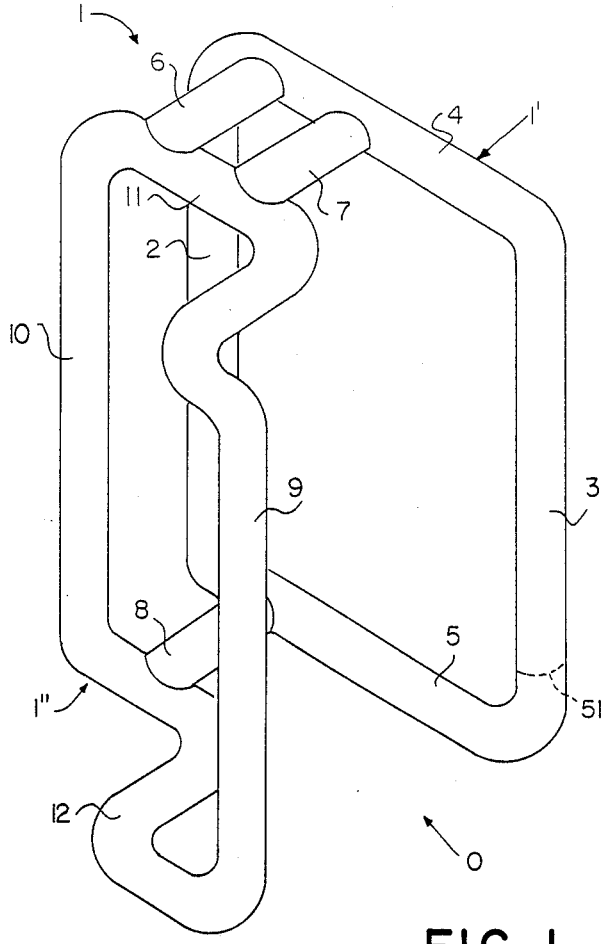

FIG. 1 shows a perspective representation of the frame 1.

A special characterizing feature of the invention is that this frame 1 consists of two single frames 1′ and 1″, connected by traverse trussings 6, 7 and 8.

Frame 1′ is formed as a rectangular frame with round corners.

Figure 1A:
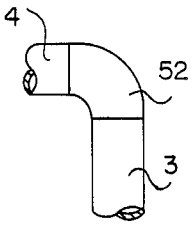

It consists of two vertical supports 2 and 3 as well as two cross pipes 4 and 5, which can be bent out of one piece and be connected at the meeting point 51 or, as depicted in FIG. 1*a*, can be composed by means of two bent pipes 52.

Frame 1″ is formed as an angled frame and is composed of two vertical supports 9 and 10 as well as an upper angled traverse pipe 11 and a lower traverse pipe 12.

Figure 2:
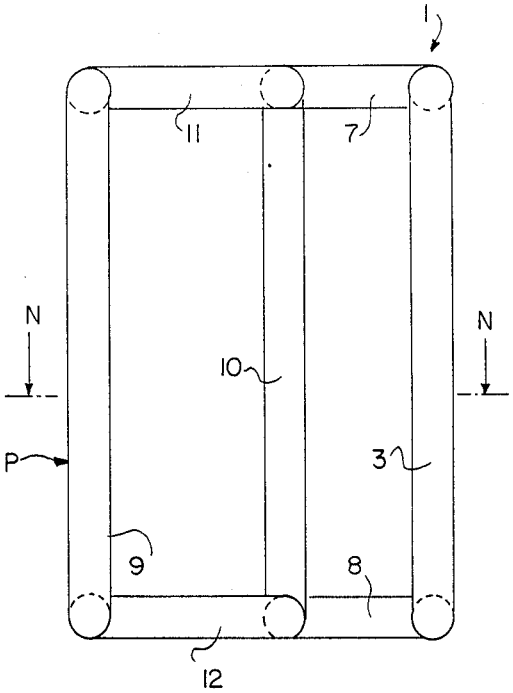

FIG. 2 shows a view of the frame 1 from the direction 0 indicated in FIG. 1.

Figure 3:
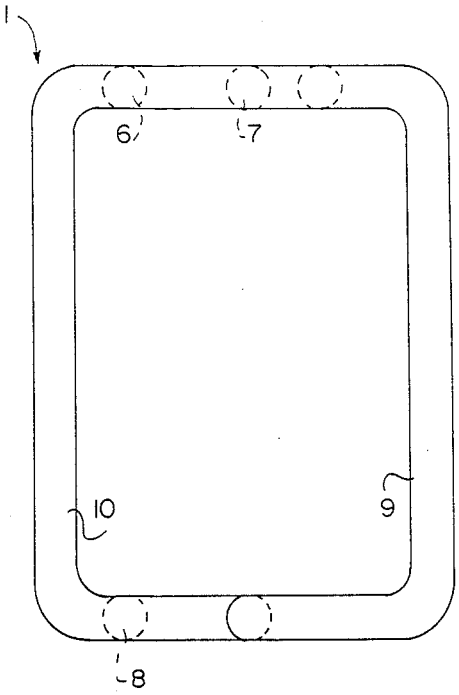

FIG. 3 is a sideview from direction P indicated in FIG. 2.

Figure 4:
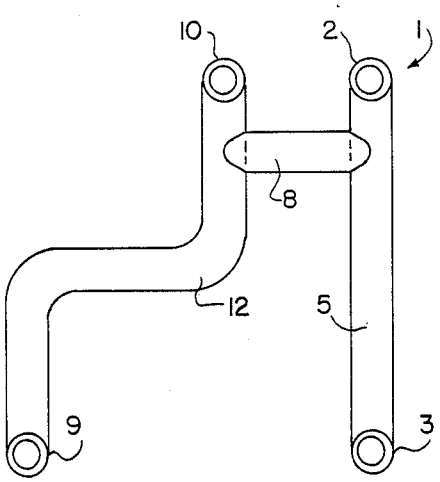
Figure 5:
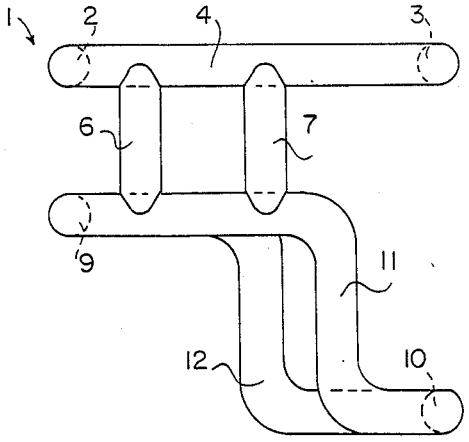

FIG. 4 is a cross sectional presentation along the line N—N indicated in FIG. 2 and FIG. 5 is an aerial view of FIG. 3.

As is apparent from FIGS. 1 to 5, it is a special feature of the invention that frame 1 in this embodiment consist of a round pipe material, preferably steel pipe material and demonstrates no dangerous edges or corners.

Due to the constructive design frame 1 is self-stabilizing. That means that during exercise no disadvantageous power relations can be created, which lead to a toppling over or shaking of the frame. It is thus possible, to set up the frame in a training room without anchoring same.

Figure 6:
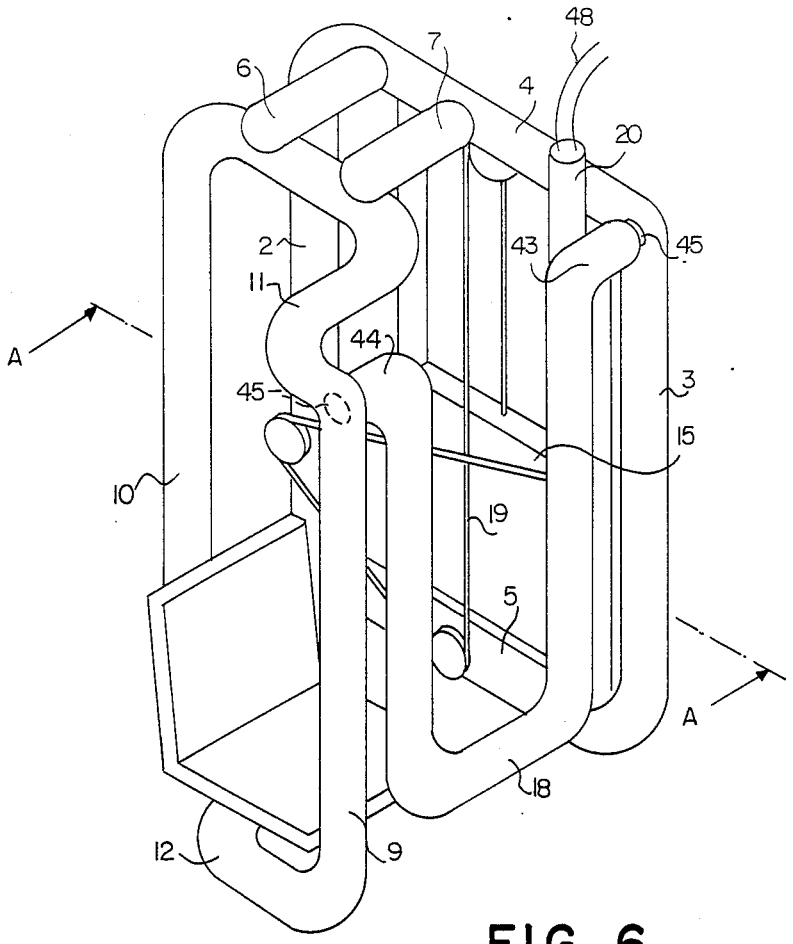
FIG. 6 is a representation in perspective of the complete fitness training apparatus in a preferred embodiment with a U-shaped lever.

FIG. 6 shows a perspective representation of the training apparatus.

In this embodiment a U-formed lever 18 is utilized. As is apparent from this, lever 18 has on both sides an angle formed modification 43 and 44, which are pivotably arranged by means of axles 45 in the vertical supports 3 and 9.

Figure 7:
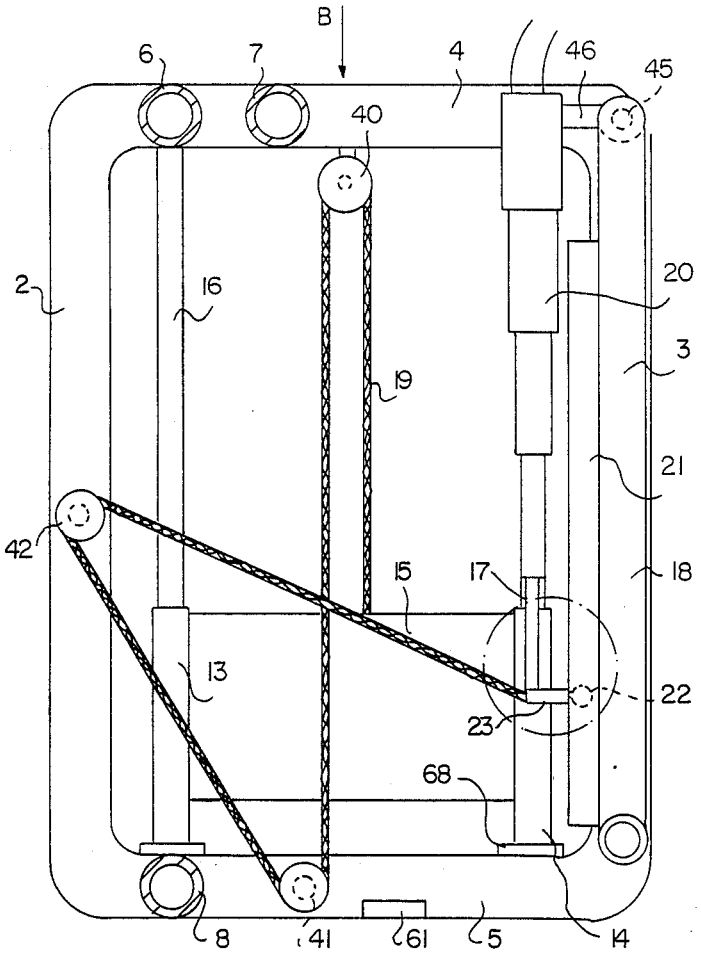
FIG. 7 is a cross-sectional view along the line A—A indicated in FIG. 6.

FIG. 7 shows a cross-sectional view along the line A—A indicated in FIG. 6.

As is apparent from this cross-sectional view, the weight power which exerts its effect on the pulling rope 19 is changed in direction via rolls 40, 41, 42 and then exerts its effect on the power transmission element 23 which is in connection with a telescope 20.

The lever arm is variably shaped by moving in or moving out of telescope 20. The telescope movement can be made electrical, pneumatic or hydraulic whereby the electronic device 61 directs the change.

In this embodiment the power transmission element 23 demonstrates a pivotably arranged roll 22, which is movably arranged in a guide rail 21. Guide rail 21 is solidly connected to lever 18, so that the weight power doesn't exert its effect on the telescope 20 but exerts its effect within the guide rail 21.

This is furthermore made possible by guiding the telescope 20 within a groove (not presented here).

In this embodiment telescope 20 is pivotable arranged by means of the distance plate 46 on axle 45 of lever 18. Thus it is achieved, that the movement of telescope 20 takes place analogous to movement of lever 18.

Figure 8:
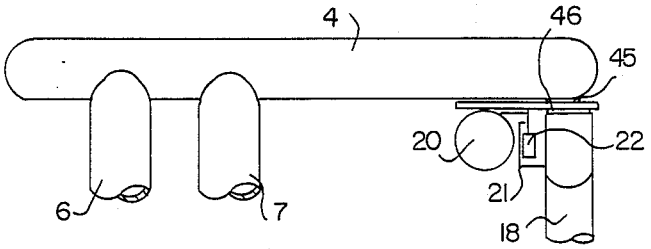
FIG. 8 is an aerial view from the direction B indicated in FIG. 7.

FIG. 8 shows an aerial view of FIG. 7 from the direction B as indicated. In this drawing it becomes apparent how the pivotably arranged roll 22 can move within the guide rail 21.

Figure 9:
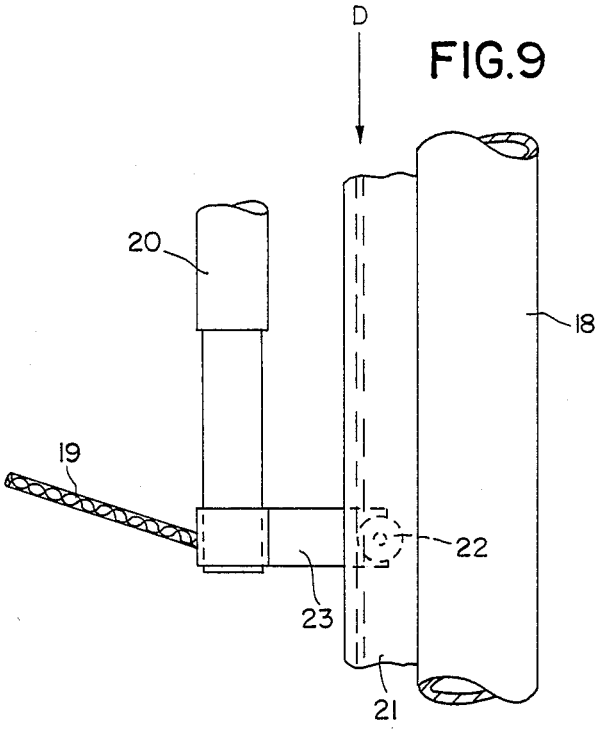
FIG. 9 is an enlargement of the part denominated with C in FIG. 7.
Figure 10:
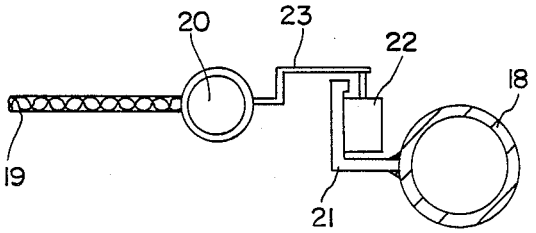
FIG. 10 is a view from the direction D indicated in FIG. 9.

FIG. 9 shows an enlargement of detail C indicated in FIG. 7 and FIG. 10 a view of FIG. 9 from direction D.

In this embodiment the power transmission element 23 is formed as a sleeve, which surrounds telescope 20. The utilization of this form is suitable, if not too large of a training power is necessary.

In the case of bigger training weights the guidance of the telescope is required in a groove or a long slit, as will be described later.

Figure 11:
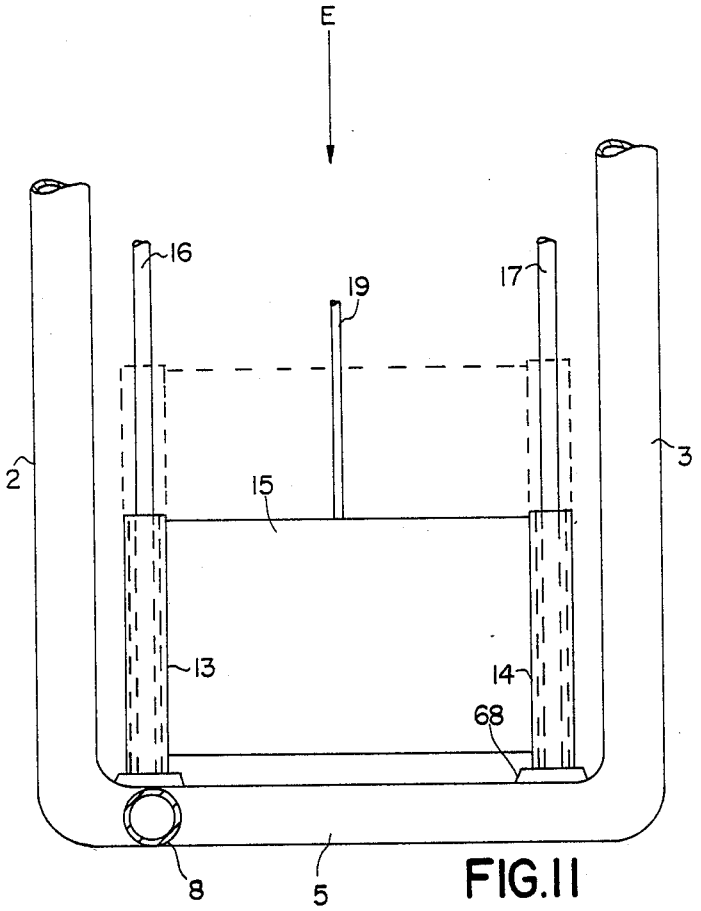
FIG. 11 is the arrangement of the weight plate in the frame.
Figure 12:
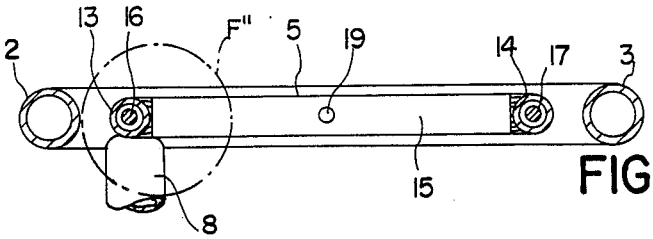
FIG. 12 is a view from the direction E indicated in FIG. 11, FIGS. 13 and 13*a* are alternate details designated with F in FIG. 12.
Figure 13:
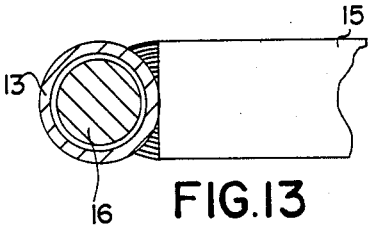

FIGS. 11 to 13 show the arrangement of a weight plate 15.

Weight plate 15 is immovably connected with sleeves 13 and 14. These sleeves 13 and 14 surround a guidance shaft 16 and 17 (each).

Since, as is apparent here, the weight power is formed only by one weight plate 15, which can be vertically moved along the guidance shafts 16 and 17 by means of sleeves 13 and 14, it is possible to give this weight plate 15 an aesthetically pleasing form. To smooth the body-plate, on the lower end of the sleeve rubber bumbers 68 or the like are attached.

Figure 13A:
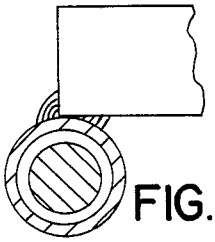

FIG. 12 is a view from direction E and as indicated in FIG. 11 and FIG. 13 is an enlargement of the detail indicated as F in FIG. 12. Also the arrangement of the weight plate 15 shown in FIG. 13*a* at sleeves 13 and 14 is possible (FIG. 13*a*), instead of, as shown in FIG. 13.

Figure 14:
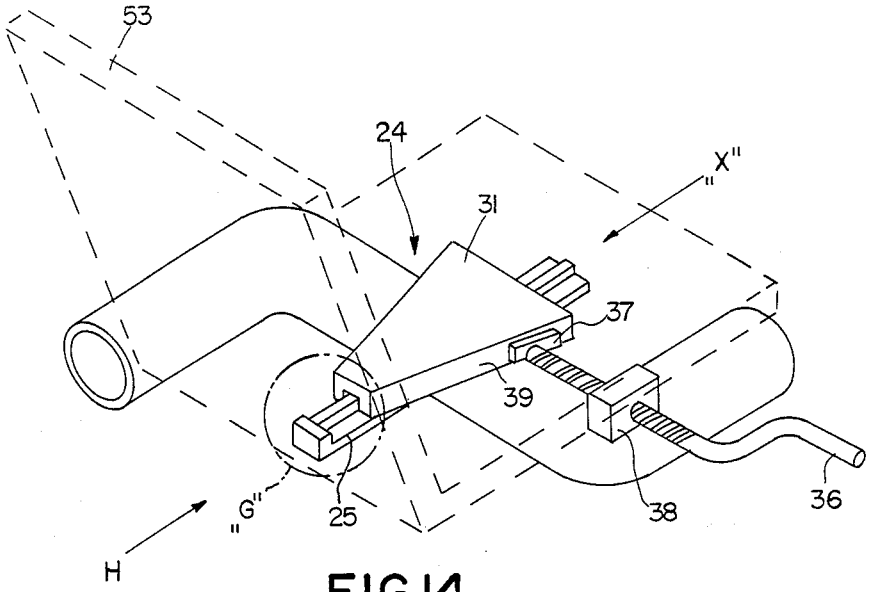
FIG. 14 is the arrangement of the seating stop.

FIG. 14 shows the seating wedge stop 24 according to the invention, which is designed according to the sometimes large training powers.

Seat 53 is only indicated with dotted lines for clarification.

Seating wedge stop 24 consists essentially of a slide wedge 31, a bung rail 25 and a screw handle 36 with a stop plate 37 and a guide wedge 38. The connection between seat 53 and slide wedge 31 can be made in such a way that slide wedge 31 is hand-in-glove formed into seat 53.

During exercise the person carrying out exercises presses oneself into the seat. Hereby forces act from the direction indicated with arrow X.

Since at least one side on the slide wedge 31, for example side 39 is formed wedge-shaped, and is pressed by the screw handle 36 with its stop plate 37, no more forces are exerted on the fixing screws or the like, which may lead to a break.

FIGS. 15 to 21 show details of this seating wedge stop 24.

Figure 15:
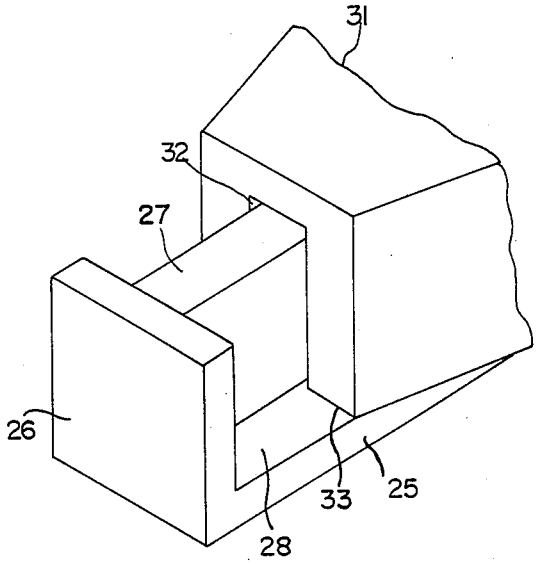
FIG. 15 is an enlargement of the part designated G in FIG. 14.

FIG. 15 shows a detail indicated with G in FIG. 14. It is apparent, that bung rail 25 has at its front side a stop 26 to limit the distance of movement. Bung 27 leads into a groove 32 of slide wedge 31. Slide wedge 31 moves with its sliding surfaces 33 on the sliding surfaces 28 of bung rail 25.

Figure 16:
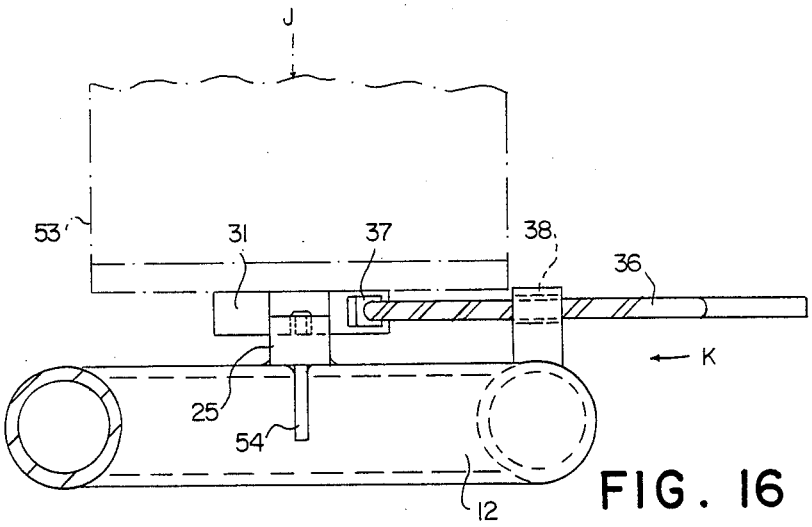
FIG. 16 is a view from direction H indicated in FIG. 14.

FIG. 16 shows a view from direction H as indicated in FIG. 14.

Figure 17:
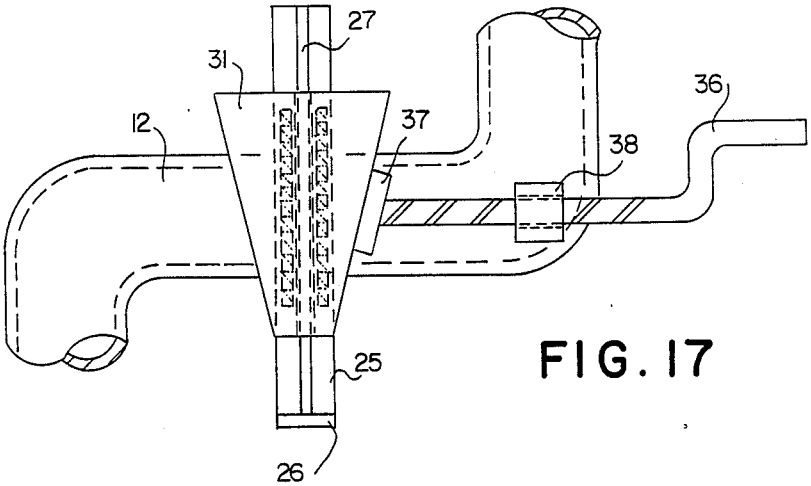
FIG. 17 is a view from the direction J indicated in FIG. 16.
Figure 18:
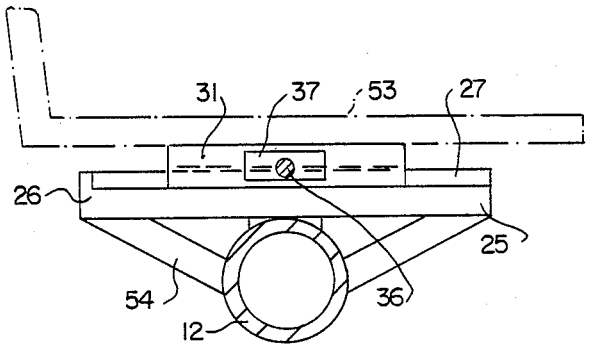
FIG. 18 is a view from the direction K indicated in FIG. 16.

FIG. 17 shows a view from direction J indicated in FIG. 16 and FIG. 18 a view from direction K indicated in FIG. 16. In order to accept the exercised forces via the seating, between bung rail 25 and pipe 12 diagonal struts 54 are arranged.

Figure 19:
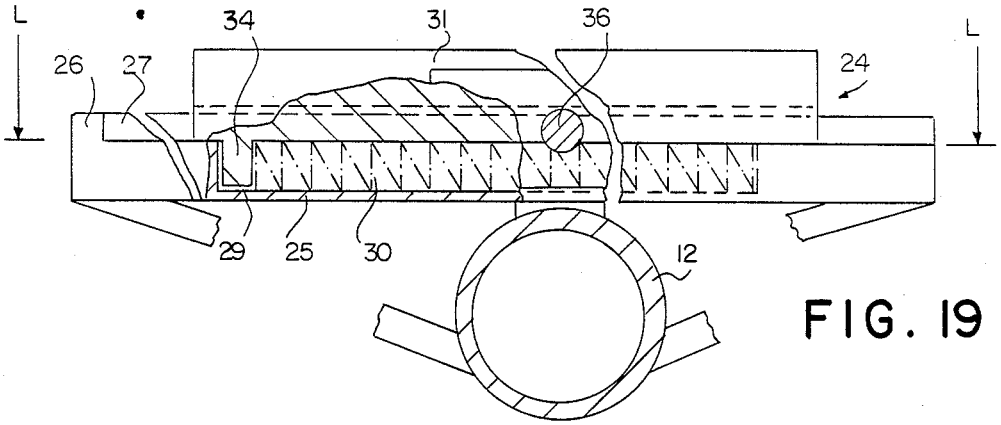
FIG. 19 is an enlargement of FIG. 18.

FIG. 19 shows an enlargement of FIG. 18 in a cross-section view representation. Herewith is apparent, that in bung rail 25 two slots 29 are introduced, which each receiving a pressure spring 30. Thus, there is permanently a small counter force in the seating wedge stop 24. The slide wedge 31 features for compressing of the pressure springs 30 two spring stops 34 and 35, which are also in the slot 29 of the bung rail 25.

Figure 20:
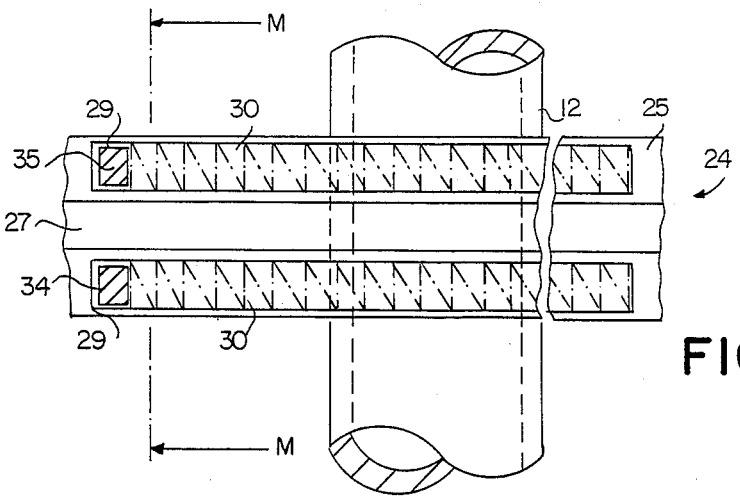
FIG. 20 is a cross sectional view of the seating wedge stop along the line L—L indicated in FIG. 19.
Figure 21:
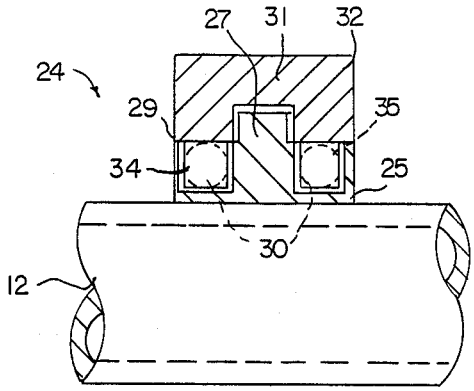
FIG. 21 is a cross-sectional view along the line M—M indicated in FIG. 20.

FIG. 20 shows a cross-sectional view along the line L—L indicated in FIG. 19 and FIG. 21 a cross sectional view along the line M—M indicated in FIG. 20.

Seat 53 can be taken out of bung rail 25 together with the slide wedge 31. The safety lock against vertical movement of the seat can consist of T-grove screws known to the art, whereupon at the bung rail 25 an appropriate counter element is arranged (not shown).

Figure 22:
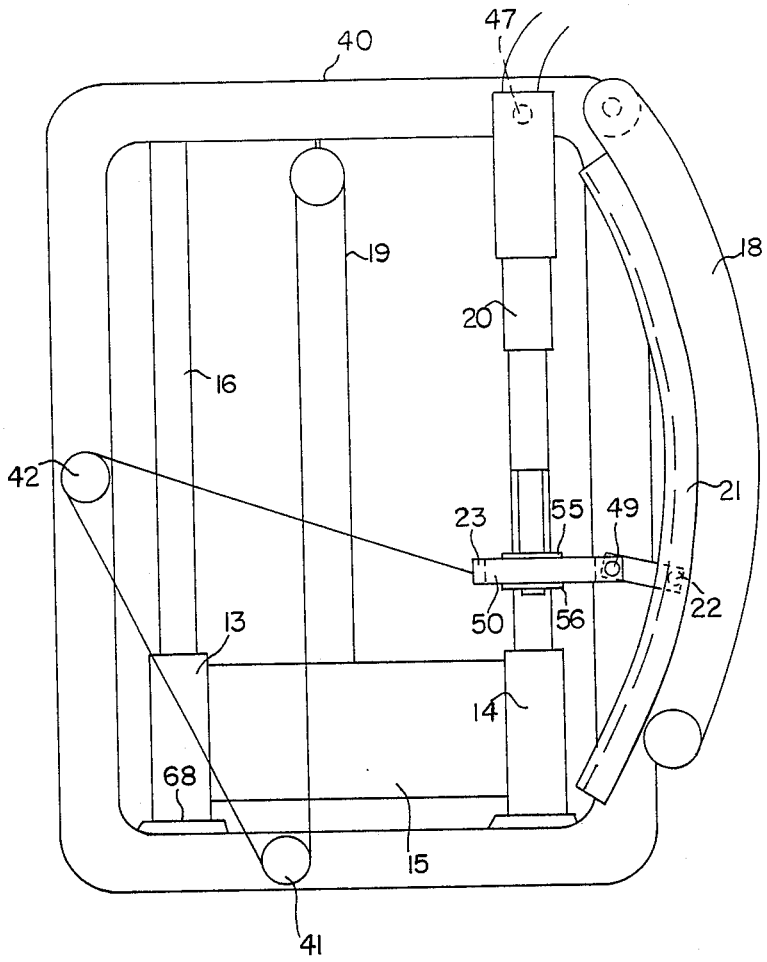
FIG. 22 is an embodiment of an example according to the invention with a bent lever arm.

FIG. 22 shows a further especially preferred embodiment of the invention, whereupon the lever 18 is in a bow-shaped form. This has the particular advantage that the traction rope 19 forms a radius around the cable guide roller 42, whereupon the length of the rope and thus the position of the weight plate 15 is not changed.

Hereby telescope 20 is independently pivotably arranged by means of an axle 47. Upon moving telescope 20 up and down, the exerting weight power is adjusted as in the embodiment with the U-shaped lever 18. Since now rope 19 or rather the power transmission element 23 form a round way within the guide rail 21 of lever 18, necessarily the positioning of telescope 20 within the power transmission element 23 changes. For this, in the power transmission element 23 a groove 50 in form of a continuous long slit is arranged. During the up and down movement of telescope 20 power transmission element 23 is also vertically moved down or up. Groove 50 assures a horizontal movement of power transmission element 23, whereby telescope 20 remains guided in this groove 50.

In this embodiment it is also possible, to arrange telescope 20 and the lever 18 by means of the distance plate 46, as shown in FIG. 7, on only one axis. However, it is then necessary, to arrange the analogous movement of the telescope 20 by means of an additional axis, not shown here, at power transmission element 23.

Figure 23:
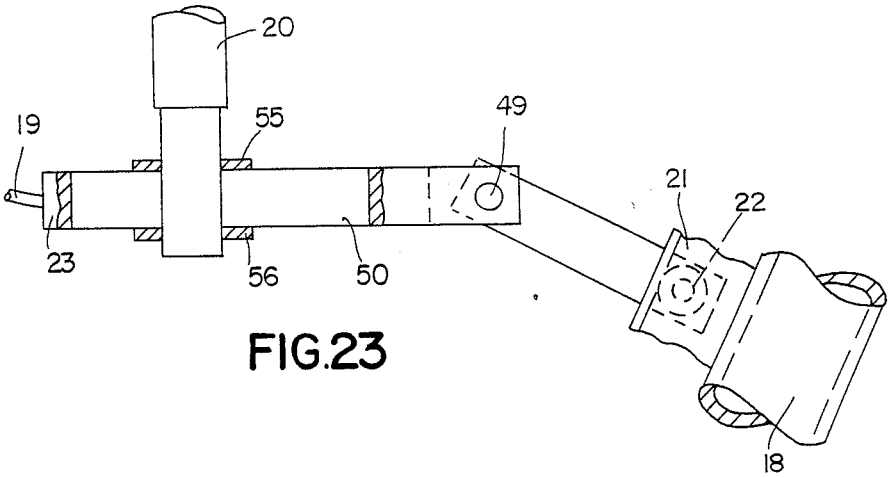
FIGS. 23 to 25 show an embodiment of a power transmission element.
Figure 24:
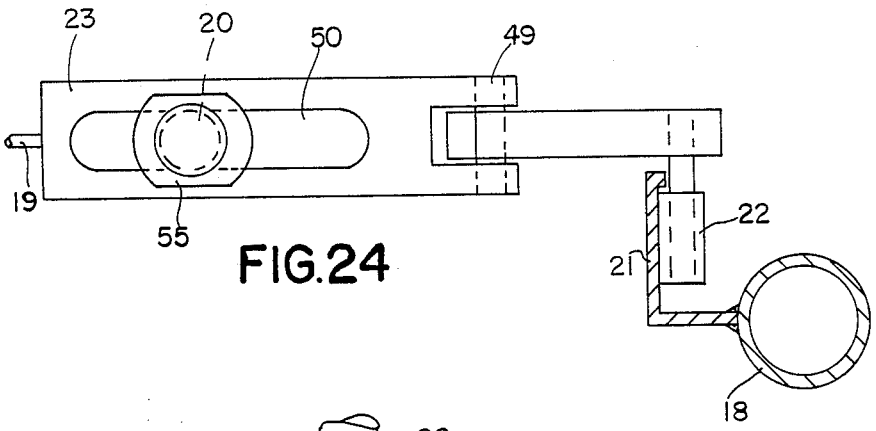
Figure 25:
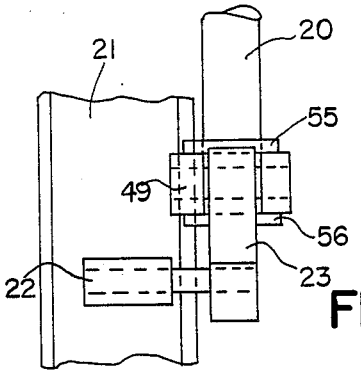
Figure 26:
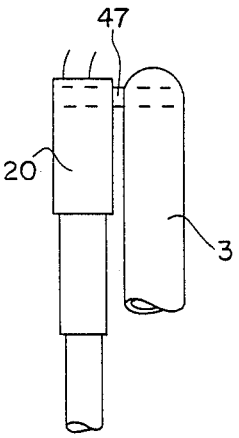
FIGS. 26 to 29 show an embodiment of telescope fixing equipment.

In FIG. 23 to 25 a further embodiment of the power transmission element 23 is shown. It is hereby apparent, that telescope 20 is horizontally movably arranged within the groove 50 which is formed as a continuous long slit, and protected by means of checking arrangement elements 55 and 56 against vertical movement. In order to achieve a better adaptation of roll 22 within the guide rail 21, this features a further axle joint 49.

FIGS. 26 to 29 show a further possibility of telescope fixation. In this embodiment telescope 20 features the axle 47 for positioning.

Figure 27:
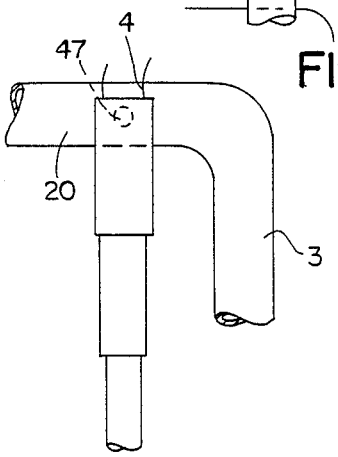
Figure 27A:
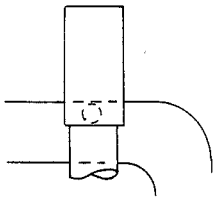
Figure 28:
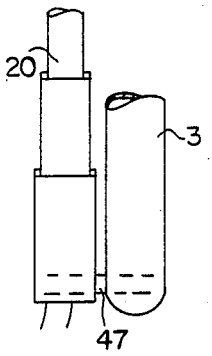
Figure 29:
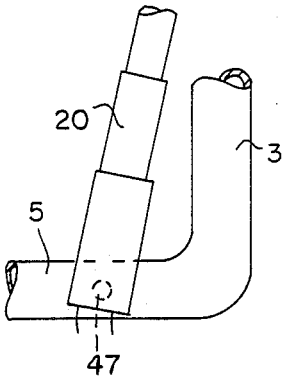

Suitable for power transmission is a positioning of the upper telescope part in height above the moving axis of the lever 18, as is shown in FIG. 27*a*.

It is to be shown that it is possible in principle to arrange telescope 20 at the upper frame part 4 as well as the lower frame part 5.

Figure 30:
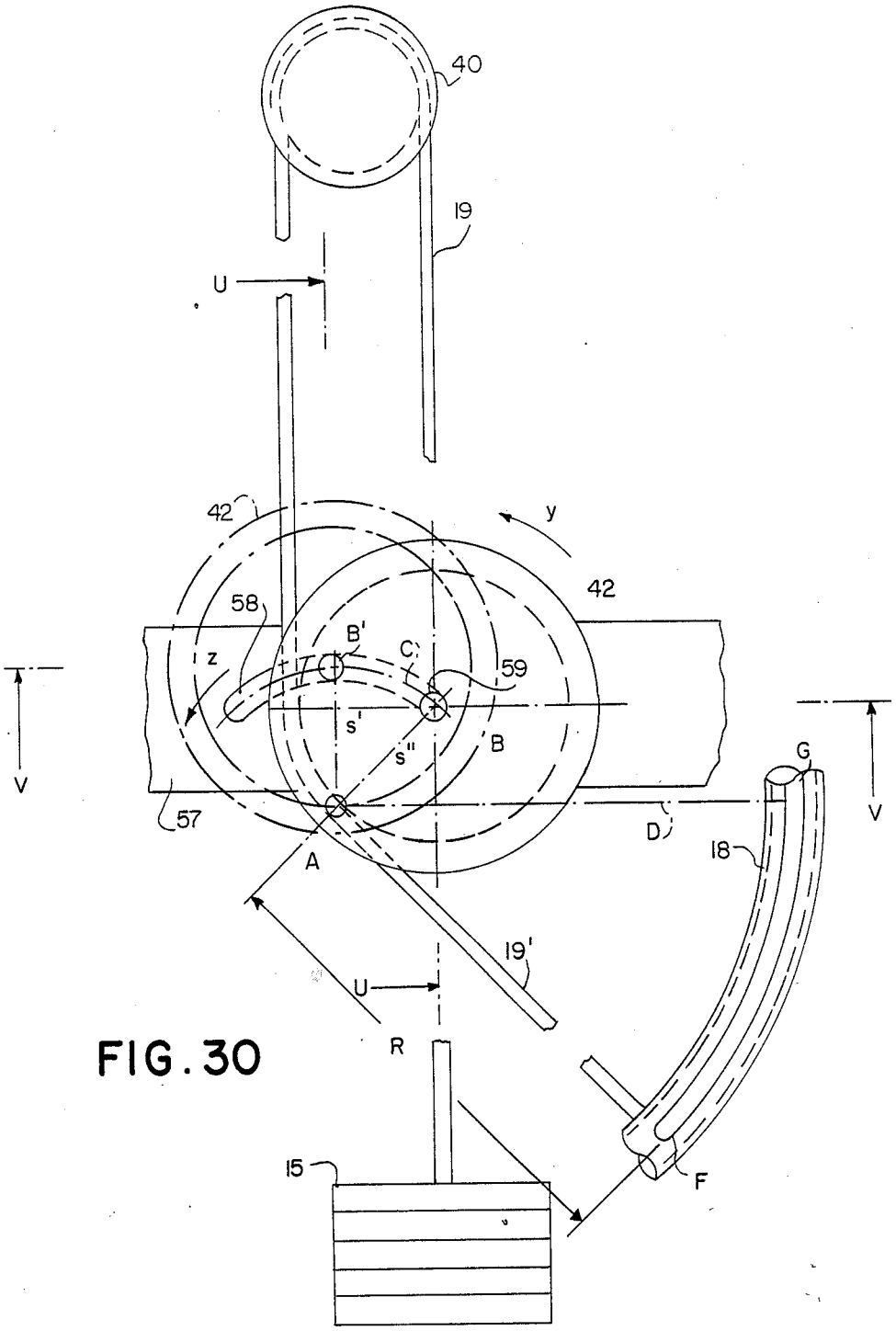
FIG. 30 is the seating of a cable guide roller.

FIG. 30 shows an example of cable guide roll 42, whereby it is to be noted, that rope 19 is led not above but below cable guide roll 42. Roll 40 and weight plate 15, as well as lever 18, are hereby schematically arranged.

For positioning of the cable guide roll 42 a plate 57 is arranged in the frame.

At this plate 57 the cable guide roll 42 is pivotably arranged.

A further particular embodiment envisions that this plate 57 features a radial groove 58. This groove has radius S and enables, besides the turning motion of cable guide roll 42 towards Y, a motion of the latter to Z, within the radial groove 58 (FIG. 30). This has the advantage, that point A remains continuously fixed. This is then necessary, if at lever arm 18 a circular movement with radius R around point A is made, which takes place by changing of the traction rope 19 within the changing equipment, here in the form of a groove.

This has the advantage, that in lever 18, with respect to production technology, a relatively simple circle movement is made, whereupon without the movability towards Z of cable guide roll 42 an elliptic movement or equipment would be necessary, whereby this embodiment is of course, also possible.

If now traction rope 19 is changed from point F to point G, then axis 59 of cable guide roll 42 moves, or axle point B within the groove 58 on the axis C to B', whereby radius S' corresponds to radius S. The attachment point A thereby always lies on the inner side 19' of the traction rope 19 and remains fixed at the same point, whereby a radius R between points A and F and radius R, which corresponds to radius R, remain constant between points A and G, thereby behaving congruently.

Figure 31:
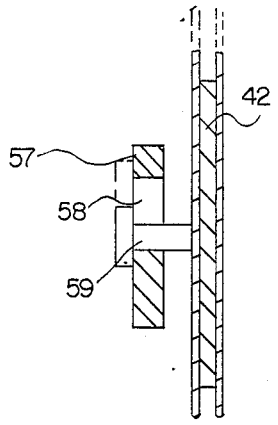
FIGS. 31 and 32 are cross-sectional view of FIG. 30, FIGS. 33 and 34 are schematic drawings of the cable guide roller positioning and the power transmission.
Figure 32:
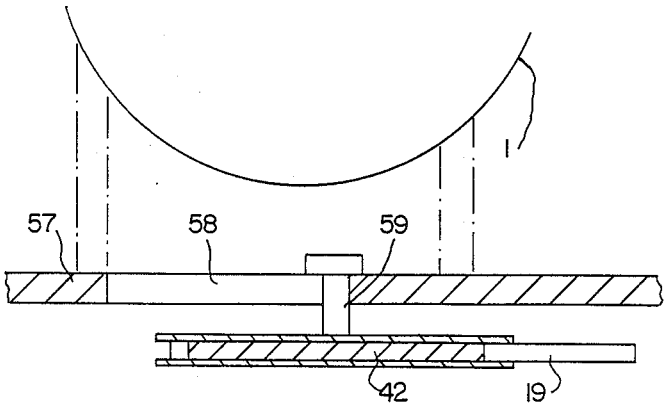

FIGS. 31 and 32 are cross sectional views according to the section lines indicated in FIG. 30. FIG. 30 shows a cross section along the line U—U and FIG. 32 a cross section along the line V—V. The same elements are described with the same reference symbols.

Figure 33:
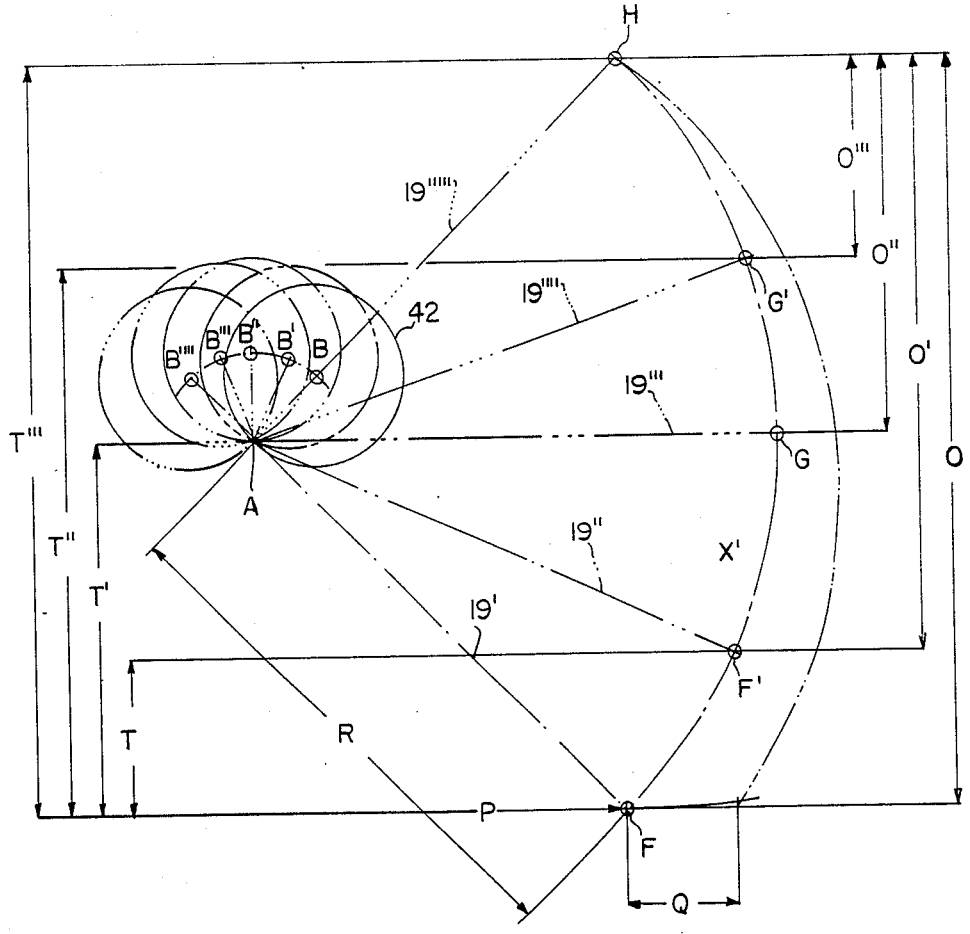

FIG. 33 shows a system sketch of the possibility for change. The axis X' of the lever 18 or the guide rail 21 surrounds point A with radius R.

Axis 19' (indicated with dashed lines) is the point of full weight burden. Since the power arm O between point H and F here has the longest extension, at point F the full weight power P for lever movement to Q has to be brought forward, since the lever arm in F is equal to Zero.

If the traction rope or the axis 19'' change the point F' in the lever arm axis X', then the power arm O' is reduced and the lever arm T is created. Thus, the reduction of the required power P according to the mechanical laws are explained.

Accordingly the relations change, if traction rope 19''' is changed into the axis position X''' in point G. Thus the power arm O'' and the lever arm T' are formed.

The traction rope positions 19'''' with power arm O''' and lever T'' in point G' are arranged continuously.

If the traction rope is moved to power line 19''''' in point H, then power arm O is equalized and the lever arm T''' is created, so that the theoretically required pressure power P equals Zero, if one neglects the friction forces.

Center point B of the cable guide roll 42 is moved in the axis C of radial groove 58, so that upon changing the following relations result:

| Traction rope position | between point | Power arm | Lever arm | Center point of roll 42 |
|---|---|---|---|---|
| 19' | A-F | 0 | — | B |
| 19'' | A-F' | 0' | T | B' |
| 19''' | A-G | 0'' | T' | B'' |
| 19'''' | A-G' | 0''' | T'' | B''' |
| 19''''' | A-H | — | T''' | B'''' |

Figure 34:
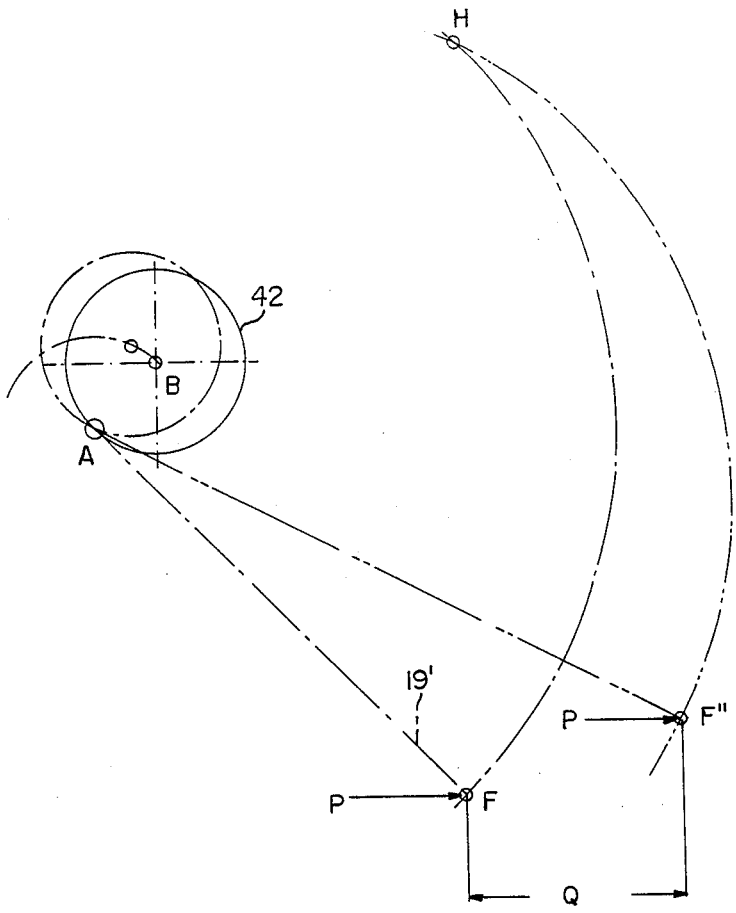

FIG. 34 again shows a system sketch, where the lever way Q only in one position, for example, full weight power via traction rope 19, exerts its effect in point F and conducts to F''.

FIGS. 35 to 38 show further embodiments of the invention.

Lever 18 is fixedly connected with the change equipment 60 which both are pivotably positioned at axis 45.

Figure 35:
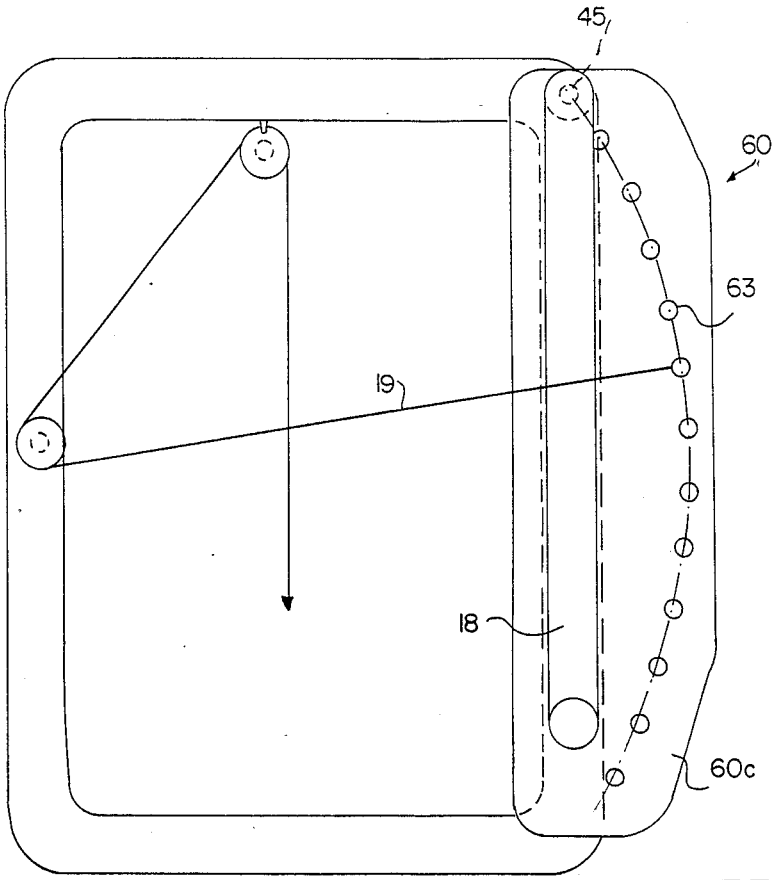
FIGS. 35 to 38 are different embodiments of the modifying equipment.
Figure 36:
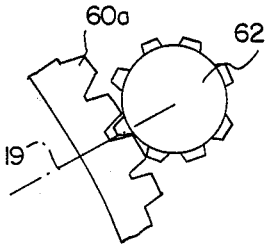
Figure 37:
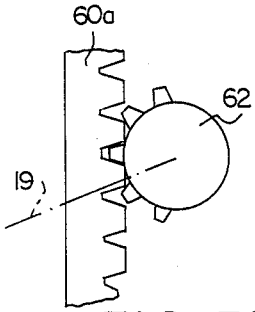
Figure 38:
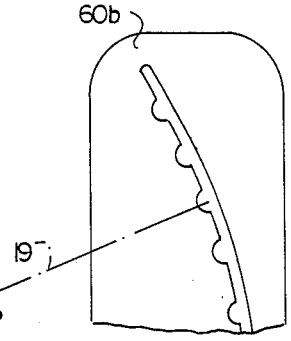

The change equipment 60 can have the form of a perforated disk as in FIG. 35, a bent or straight gear rack as in FIG. 36 or 37 or a slotted disk as in FIG. 38.

Upon utilization of a gear rack **60*a* at the end of rope 19 there has to be a rolling gear wheel 62. The setting can take place manually or automatically, whereby the possibility for setting in the embodiment of FIG. 35 takes place manually, by means of putting the rope into the holes 36 of perforated disk 60*c***.

FIGS. 39 and 40 show an additional embodiment of the seating equipment. To avoid a complicated fixation of the previously described seating wedge stop 24, however to achieve an extremely stable form of the seating equipment, there is the possibility to stably fix at frame 1 a seat and to achieve a setting possibility, to form the back rest **53*a* of seat 53 in a reversibly fixable manner. That means back rest 53*a* features two casings 64, which fit the appropriate receiving element 65 on the opposite seat bank. These are arranged on both sides of the seating face 53*b* and feature borings 66 to accept the casings 64**.

The training apparatus according to the invention opens new kinds of training possibilities, since the desired weight power can be variably adjusted by means of a switch from the seating, whereby the guide rail 21, that means the lower dead point, can be utilized beyond lever 18, so that an extended lever 18 can be formed and thus, the required training power can be choosen beyond the actual weight power. The upper dead point of the guide rail 21 always is at the lever joint.

Furthermore due to the constructive design no undesired vibrations occur within the training apparatus, thus no injuries to muscles can occur, as they could result in the known training apparatuses.

Moreover the danger of accidents by means of easily accessible and movable weight is no longer possible, since the weight plate can be enclosed in a casing. Due to the arrangement of a particularly stable seating wedge locking there is no loner a danger of the material breakage within the seating locking.

In the aforementioned embodiments the variant of a training apparatus for exercising the leg muscles is presented.

However, the technique can be utilized for any other muscle training apparatus and this is done so. There are possible with this technique for example arm trainers, shoulder trainers, latissinus trainers, chest trainers, stomach trainers, calf trainers, backside trainers, triceps trainers etc.

I claim:

1. An exercising apparatus, comprising:

(a) a frame including a plurality of cable guide rolls;

(b) a single weight plate movably attached to the frame;

(c) a lever movably mounted to the frame to be moved by the user of the apparatus during exercising;

(d) a telescope movably connected relative to the frame and operatively connected to the lever, said telescope being remotely controllable by the user to create variable weight power for the apparatus;

(e) a seat adjustably mounted to the frame, upon which the user sits;

(f) a cable connected between the weight, the telescope and the frame via the plurality of cable guide rolls; and (g) a power transmission element connected to the lever via a turnable roll, wherein the power transmission element is a sleeve which surrounds the telescope and is connected with the cable.

2. The apparatus according to claim 1, wherein the power transmission element is two pieces pivotally connected.

3. The apparatus according to claim 1, wherein the lever includes a guide rail for receiving the turnable roll.

4. The apparatus according to claim 3, wherein the guide rail is angular.

5. An exercising apparatus, comprising:

(a) a frame including a plurality of cable guide rolls;

(b) a single weight plate movably attached to the frame;

(c) a lever movably mounted to the frame to be moved by the user of the apparatus during exercising;

(d) a telescope movably connected relative to the frame and operatively connected to the lever, said telescope being remotely controllable by the user to create variable weight power for the apparatus;

(e) a seat adjustably mounted to the frame, upon which the user sits;

(f) a cable connected between the weight, the telescope and the frame via the plurality of cable guide rolls; and (g) a power transmission element connected to the lever via turnable roll, wherein the telescope is arranged movably within a groove in the power transmission element.

6. An exercising apparatus, comprising:

(a) a frame including a plurality of cable guide rolls;

(b) a single weight plate movably attached to the frame;

(c) a lever movably mounted to the frame to be moved by the user of the apparatus during exercising, wherein the lever is formed in an arch shape and includes a setting mechanism in the form of a gear rack, a slotted disk and a perforated disk, (d) a telescope movably connected relative to the frame and operatively connected to the lever, said telescope being remotely controllable by the user to create variable weight power for the apparatus;

(e) a seat adjustably mounted to the frame, upon which the user sits; and (f) a cable connected between the weight, the telescope and the frame via the plurality of cable guide rolls.

7. An exercising apparatus, comprising:

(a) a frame including a plurality of cable guide rolls, wherein one of the plurality of cable guide rolls is pivaotably arranged on a plate fixed to frame;

(b) a single weight plate movably attached to the frame;

(c) a lever movably mounted to the frame to be moved by the user of the apparatus during exercising;

(d) a telescope movably connected relative to the frame and operatively connected to the lever, said telescope being remotely controllable by the user to create variable weight power for the apparatus;

(e) a seat adjustably mounted to the frame, upon which the user sits; and (f) a cable connected between the weight, the telescope and the frame via the plurality of cable guide rolls.

8. The apparatus according to claim 7, wherein the plate includes a radial groove in which the cable guide roll is pivotably arranged by a shaft.

* * * * *